US009101253B2

(12) United States Patent
Johnstone et al.

(10) Patent No.: US 9,101,253 B2
(45) Date of Patent: Aug. 11, 2015

(54) APPARATUS AND METHODS FOR REMOVING MATERIAL FROM A SURFACE

(71) Applicant: Quirky, Inc., New York, NY (US)

(72) Inventors: Jim Johnstone, Urbana, IL (US); John Thomas Jacobsen, New York, NY (US); Jessica Fugler, London (GB)

(73) Assignee: QUIRKY, INC., New York, NY (US)

( * ) Notice: Subject to any disclaimer, the term of this patent is extended or adjusted under 35 U.S.C. 154(b) by 153 days.

(21) Appl. No.: 13/737,766

(22) Filed: Jan. 9, 2013

(65) Prior Publication Data

US 2013/0174367 A1 Jul. 11, 2013

Related U.S. Application Data

(63) Continuation-in-part of application No. 29/410,753, filed on Jan. 11, 2012, now Pat. No. Des. 705,511.

(60) Provisional application No. 61/585,472, filed on Jan. 11, 2012.

(51) Int. Cl.

| | |
|---|---|
| ***A47L 13/02*** | (2006.01) |
| ***A47L 13/11*** | (2006.01) |
| ***A47L 13/08*** | (2006.01) |
| ***A47L 13/022*** | (2006.01) |

(52) U.S. Cl.

CPC ..... *A47L 13/08* (2013.01); *A47L 13/022* (2013.01); *A47L 13/11* (2013.01)

(58) Field of Classification Search

CPC ..... A47L 13/02; A47L 13/08; A47L 13/11; A47L 13/12

USPC ..... 15/236.01, 236.02, 236.05, 236.06, 15/245, 121; 30/169

See application file for complete search history.

(56) References Cited

U.S. PATENT DOCUMENTS

| | | | | |
|---|---|---|---|---|
| 3,214,834 | A * | 11/1965 | Bell | 30/169 |
| 4,091,579 | A | 5/1978 | Giangiulio | |
| 4,305,175 | A * | 12/1981 | Burgess, Jr. | 15/236.02 |
| 5,263,222 | A | 11/1993 | Johnstone, II | |
| 6,216,306 | B1 | 4/2001 | Esterson et al. | |
| 6,243,906 | B1 * | 6/2001 | Holliday et al. | 15/111 |
| D460,589 | S | 7/2002 | Weinberger et al. | |
| 7,249,393 | B2 * | 7/2007 | Marion et al. | 15/236.02 |

(Continued)

OTHER PUBLICATIONS

The above references were cited in the International Search Report issued on Mar. 26, 2013, in International Application No. PCT/US13/20883.

*Primary Examiner* — Laura C Guidotti

(74) *Attorney, Agent, or Firm* — Cowan, Liebowitz & Latman, P.C.; Steven D. Underwood

(57) ABSTRACT

One exemplary aspect comprises a device for removing material from a surface, comprising: (a) a head component comprising a first handle portion and a first scraper portion; and (b) a shaft component comprising a rod portion and a second handle portion. In various exemplary embodiments: (1) the first handle portion is suitable for receiving a portion of a user's hand; (2) the head component further comprises a second scraper portion; (3) the second scraper portion comprises a blade with a serrated edge; (4) the second scraper portion comprises a squeegee blade; (5) the second scraper portion comprises a metal blade; (6) the head component further comprises a third scraper portion; (7) the first handle portion comprises a rubber grip component; and (8) the rod portion comprises a telescoping rod.

49 Claims, 11 Drawing Sheets

(56) References Cited

U.S. PATENT DOCUMENTS

| | | | | |
|---|---|---|---|---|
| 7,526,831 | B2 | 5/2009 | Weinberger et al. | |
| 7,814,610 | B2 | 10/2010 | Weinberger et al. | |
| 2008/0034525 | A1* | 2/2008 | Panfili et al. | 15/236.01 |
| 2009/0188061 | A1 | 7/2009 | Cybulski et al. | |
| 2009/0217471 | A1 | 9/2009 | Weinberger et al. | |
| 2010/0186183 | A1 | 7/2010 | Weinberger et al. | |

* cited by examiner

APPARATUS AND METHODS FOR REMOVING MATERIAL FROM A SURFACE

CROSS-REFERENCE TO RELATED APPLICATIONS

This application claims priority to U.S. Provisional Patent Application No. 61/585,472, filed Jan. 11, 2012, entitled "Apparatus for Removing Material from a Planar Surface." This application also claims priority to U.S. Design patent application No. 29/410,753, filed Jan. 11, 2012, entitled "Scraping Device." The entire contents of that provisional application and that design application are incorporated herein by reference.

INTRODUCTION

Exemplary embodiments described herein relate to devices and methods for removing material from a surface.

While various devices for removing ice and other material from surfaces are known (see, for example, U.S. Pat. No. 6,990,705, to Schouten et al.), these devices typically all suffer from the same disadvantage: when the ice is thick, or otherwise difficult to remove, the scraper may simply float over the surface of the ice, or only remove a thin layer at a time.

What is needed is a device suitable for scraping ice that is: (a) lightweight and portable (i.e., suitable for storing in a car); (b) capable of performing various separate but related tasks (e.g., scraping ice, chipping or breaking ice, removing water, etc.); and (c) capable of allowing a user to apply sufficient force to remove stubborn ice.

Exemplary embodiments described herein comprise a collapsible double-blade ice scraper that is configured to allow a user to comfortably and safely use both hands, and thus apply more force, when scraping, for example, an ice-covered windshield.

Exemplary features comprise one or more of: (a) a double-blade design that allows a user to scrape with both forward and backward motions; (b) a "front" handle that allows a user to scrape with less strain and more force; (c) an extendable, telescoping arm for better reach; (d) fits under a typical car seat; (e) front "plow" prevents snow from accumulating on users' hands and/or gloves; and (f) rubber-coated front and rear handles for solid grip.

Exemplary materials comprise a plastic head, a stainless steel handle, and rubber grips. The overall length may extend, for example, from 25 inches to 36 inches. Additional details and variations are described herein.

One exemplary aspect comprises a device for removing material from a surface, comprising: (a) a head component comprising a first handle portion and a first scraper portion; and (b) a shaft component comprising a rod portion and a second handle portion.

In various exemplary embodiments: (1) the first handle portion is suitable for receiving a portion of a user's hand; (2) the head component further comprises a second scraper portion; (3) the second scraper portion comprises a blade with a serrated edge; (4) the second scraper portion comprises a squeegee blade; (5) the second scraper portion comprises a metal blade; (6) the head component further comprises a third scraper portion; (7) the third scraper portion comprises a squeegee blade; (8) the third scraper portion comprises a blade with a serrated edge; (9) the third scraper portion comprises a metal blade; (10) the first handle portion comprises an aperture suitable for receiving a portion of a user's hand; (11) the first handle portion comprises a rubber grip component; and (12) the rod portion comprises a telescoping rod.

Other exemplary aspects and embodiments, and their advantages, will be apparent from the drawings and description below.

DETAILED DESCRIPTION OF CERTAIN EXEMPLARY EMBODIMENTS

Figure 1:
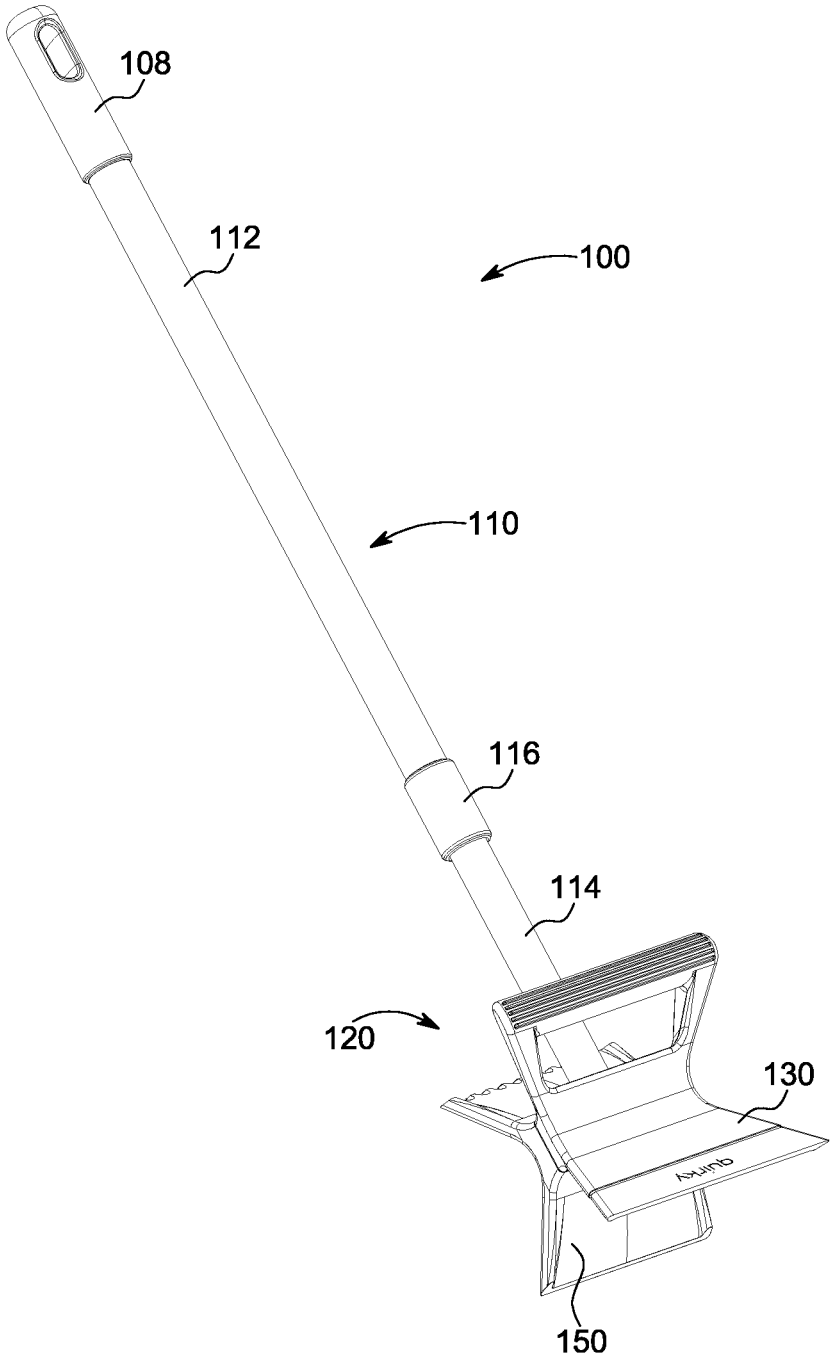
FIG. 1 is a perspective view of an exemplary device embodiment.
Figure 2:
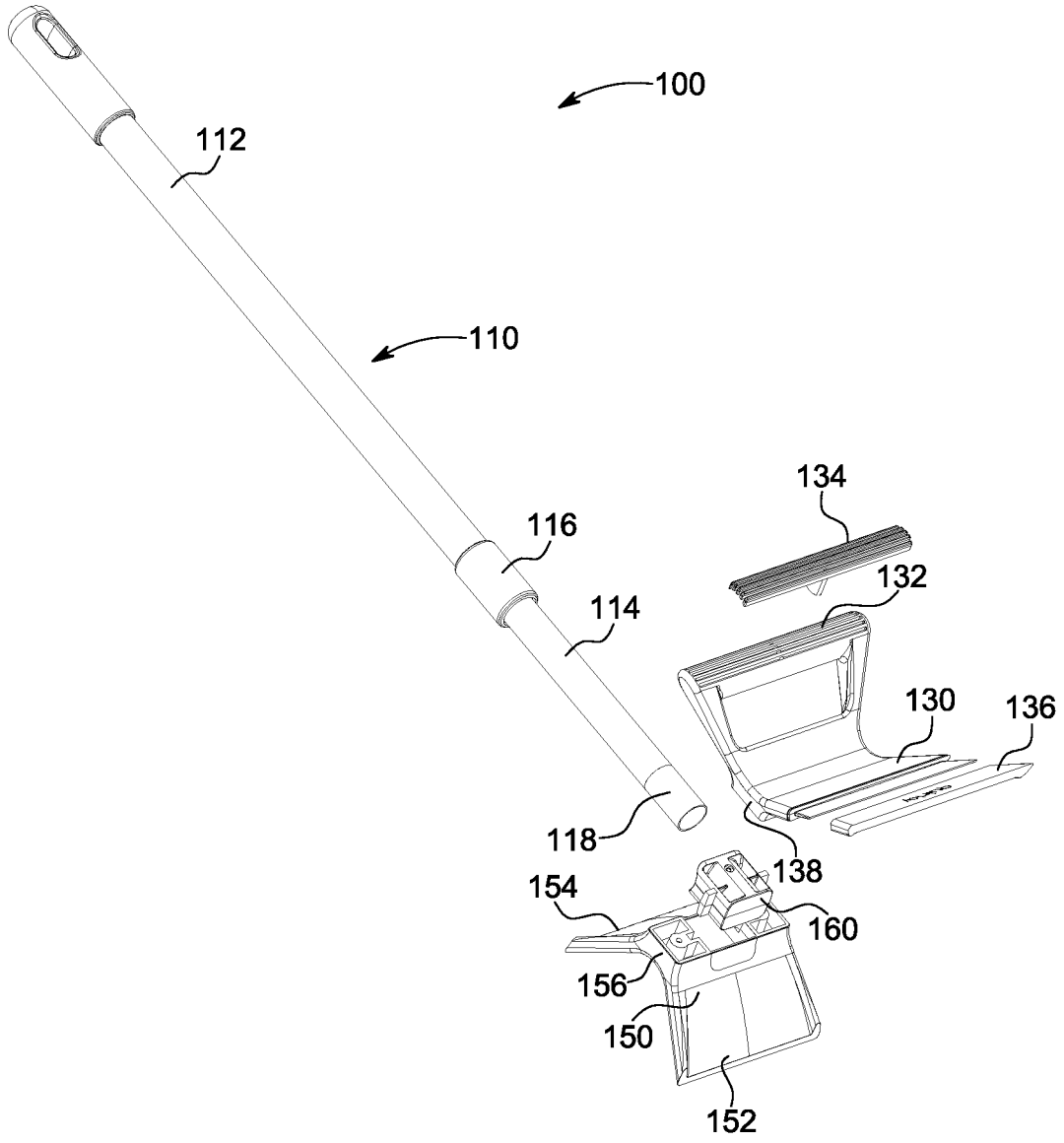
FIG. 2 is an exploded view of the device of FIG. 1.
Figure 3:
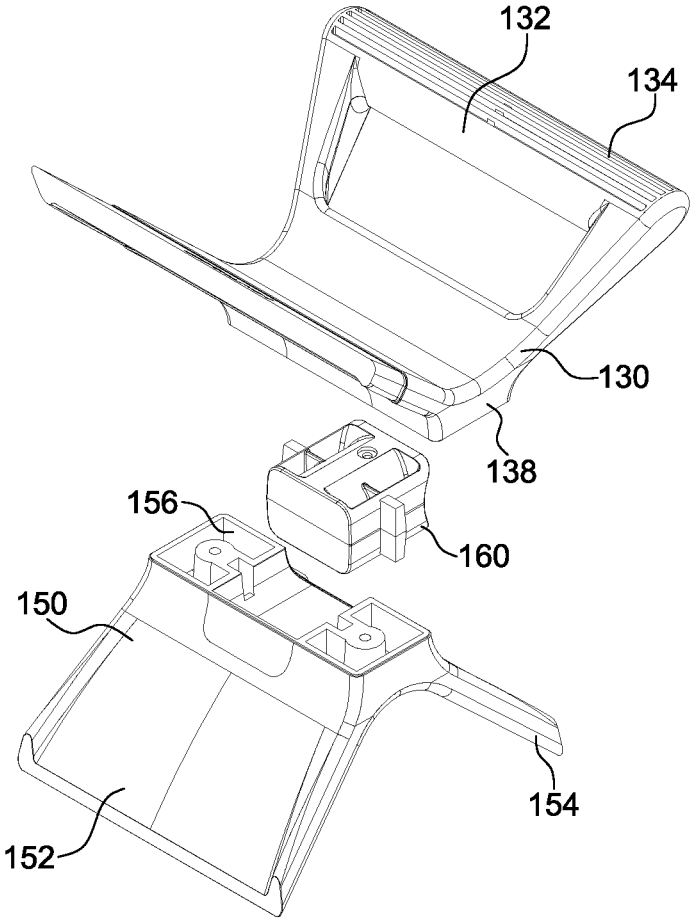
FIG. 3 is an exploded view of an exemplary head assembly.

Referring to FIGS. 1 and 2, a device embodiment 100 for removing material from a surface includes a rod assembly 110 and a tool head assembly 120. Rod assembly 110 includes an upper rod 112, a telescoping rod 114, and an adjustment mechanism 116. Upper rod 112 may be any suitable size, shape, length, or configuration and may be formed from any suitable material. For example, in some embodiments, the upper portion 112 may be formed from a plastic (e.g., PP, LDPE, PC, ABS) and/or a metal (e.g., aluminum).

In some embodiments, upper rod 112 may define a substantially annular shape and may be configured to receive at least a portion of the telescoping rod 114. In such embodiments, the upper rod 112 may define an inner diameter (e.g., the inner diameter defined by the annular shape of the upper rod 112) and an outer diameter. The inner and outer diameter of the upper rod 112 may be any suitable size.

As shown in FIGS. 1 and 2, upper rod 112 may include a handle portion 108 including an aperture. The handle portion may be used to hang and/or store the device 100. For example, in some embodiments, the device 100 may be hung from the aperture on a hook, nail, and/or the like. The handle portion may be formed from any suitable material or materials such as, for example, a plastic or rubber.

The telescoping rod 114 may be any suitable size, shape, length, or configuration and may be formed from any suitable material. For example, in some embodiments, the telescoping rod 114 may be formed from the same or similar material as upper rod 112. The telescoping rod 114 may be configured to be operably coupled to the upper rod 112, as described in further detail herein. More specifically, telescoping rod 114 may define an outer diameter configured to be slightly smaller than the inner diameter defined by the annular shape of the upper rod 112. In this manner, an end of the telescoping rod 114 may be inserted into an end of the upper rod 112.

An adjustment mechanism 116 may be rotatably coupled to the upper rod 112 and selectively coupled to the telescoping rod 114. Expanding further, the adjustment mechanism 116 may include a sleeve configured to selectively engage the telescoping rod 114 such that the sleeve maintains the position of the telescoping rod 114 with respect to the upper rod 112. In use, the adjustment mechanism 116 may be rotated such that the sleeve tightens around an outer surface of the telescoping rod 114. In this manner, the telescoping rod 114 may be positioned within the upper rod 112 such that the rod assembly is a desired length and the adjustment mechanism 116 can be rotated, thereby locking the telescoping rod 114 in the desired position relative to the upper rod 112. In other embodiments, the adjustment mechanism 116 may be any suitable mechanism.

Figure 4:
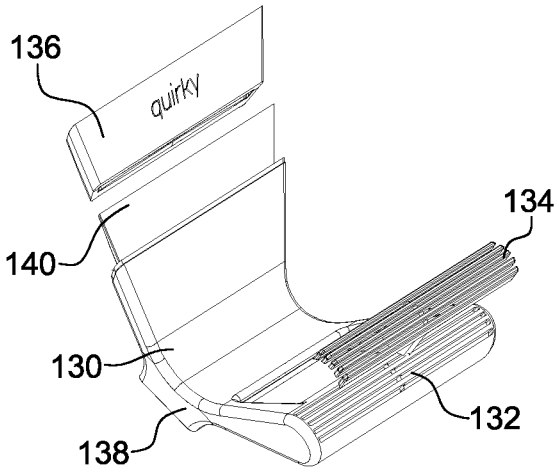
FIGS. 4 and 5 depict an exemplary first (handle) portion
Figure 5:
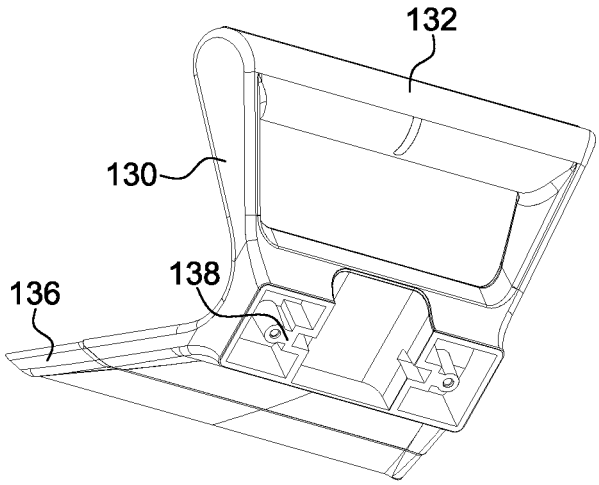

Referring now to FIGS. 3-8, a tool head assembly 120 may include a first portion 130, a second portion 150, and a coupling member 160. As shown in FIGS. 4 and 5, the first portion 130 includes a grip 132, a blade 136, and a mount 138. The first portion 130 may be any suitable shape, size or configuration and may be formed from any suitable material. For example, in some embodiments, the first portion 130 may be formed from a substantially rigid plastic or polymer. In other embodiments, the first portion 130 may be formed from a metal, such as, for example, aluminum.

In some embodiments, the first portion 130 may define a substantially arcuate path. In such embodiments, the mount 138 may extend away from a convex surface of the arcuate path. The grip 132 includes a rubber insert 134 configured to increase the ergonomics of the grip 132. In this manner, the user of the device 100 may engage at least a portion of the grip 132 to control the tool head assembly 120.

In some embodiments, the rubber insert 134 may be configured to protect a surface (e.g., a painted surface) from grip 132. Furthermore, grip 132 may include an opening configured to receive a portion of a users hand when in use. As shown in FIG. 4, the blade 136 may be disposed about a protrusion 140 extending from a surface of the first portion 130 or disposed in a recess in the first portion 130. In this manner, blade 136 may be used to remove material from a surface, as described in further detail herein. In some embodiments, blade 136 may be remove-ably or fixedly coupled to the first portion 130. In some embodiments, blade 136 may be unitarily formed with the first portion 130. In various exemplary embodiments blade 136 may be a flexible rubber material (so that the blade functions as a "squeegee"), a rigid plastic material, or a metal such as, for example, stainless steel. In some embodiments, blade 136 may be a sharpened blade such as, for example, a razor blade.

Figure 6:
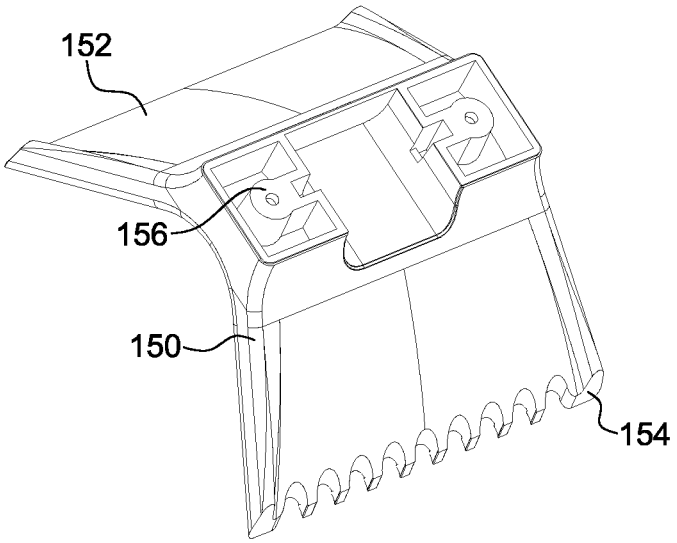
FIGS. 6 and 7 depict an exemplary second (scraper) portion.
Figure 7:
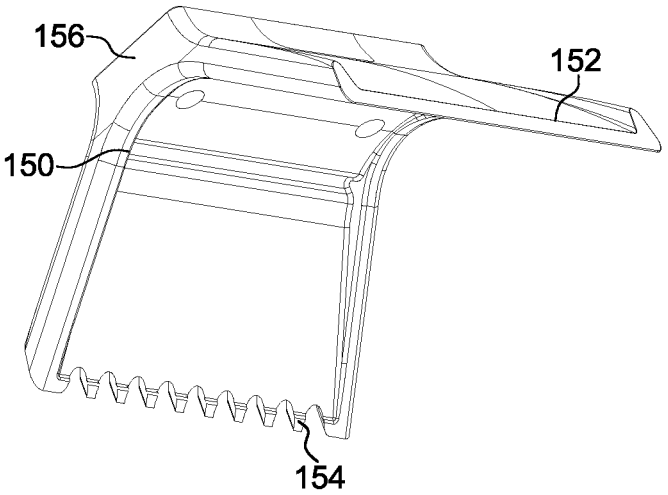

FIGS. 6 and 7 illustrate an exemplary second portion 150 of the tool head assembly 120. The second portion 150 may include a scraping member 152, a chipping member 154, and a mount 156. The second portion 150 may be any suitable shape, size or configuration and may be formed from any suitable material. For example, in some embodiments, the second portion 150 may be formed from a rigid plastic, polymer, metal, and/or the like.

In some embodiments, the second portion 150 may define a substantially arcuate path. In such embodiments, the mount 156 may extend away from a convex surface of the arcuate path. The scraping member 152 may include a relatively sharp edge configured to engage a surface to remove material from the surface. For example, in some embodiments, the scraping member 152 may be configured to scrape ice from a surface, such as a window. The chipping member 154 may include a relatively sharp edge that may be substantially serrated. In this manner, the chipping member 154 may be used to engage and chip away material from the surface.

Figure 8:
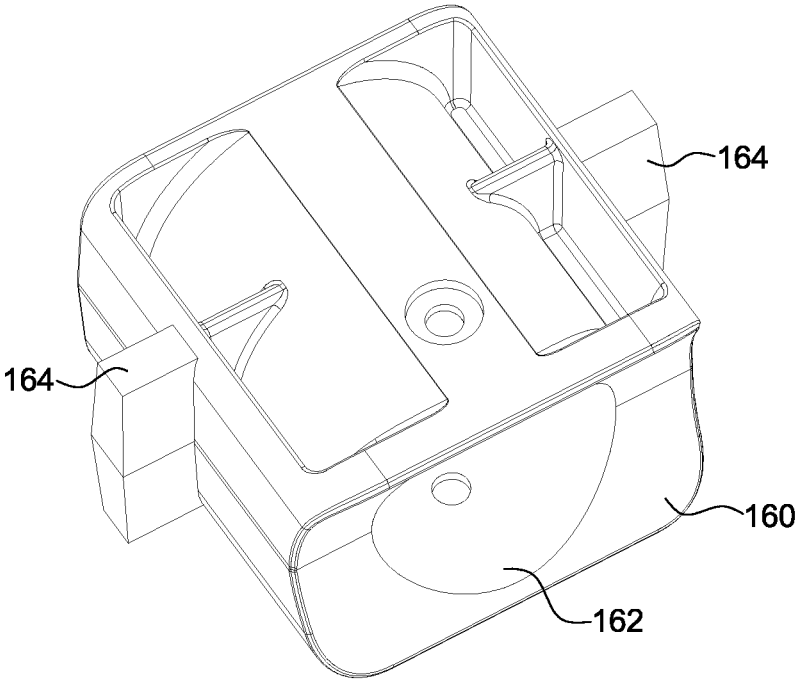
FIG. 8 depicts an exemplary coupler member.
Figure 9:
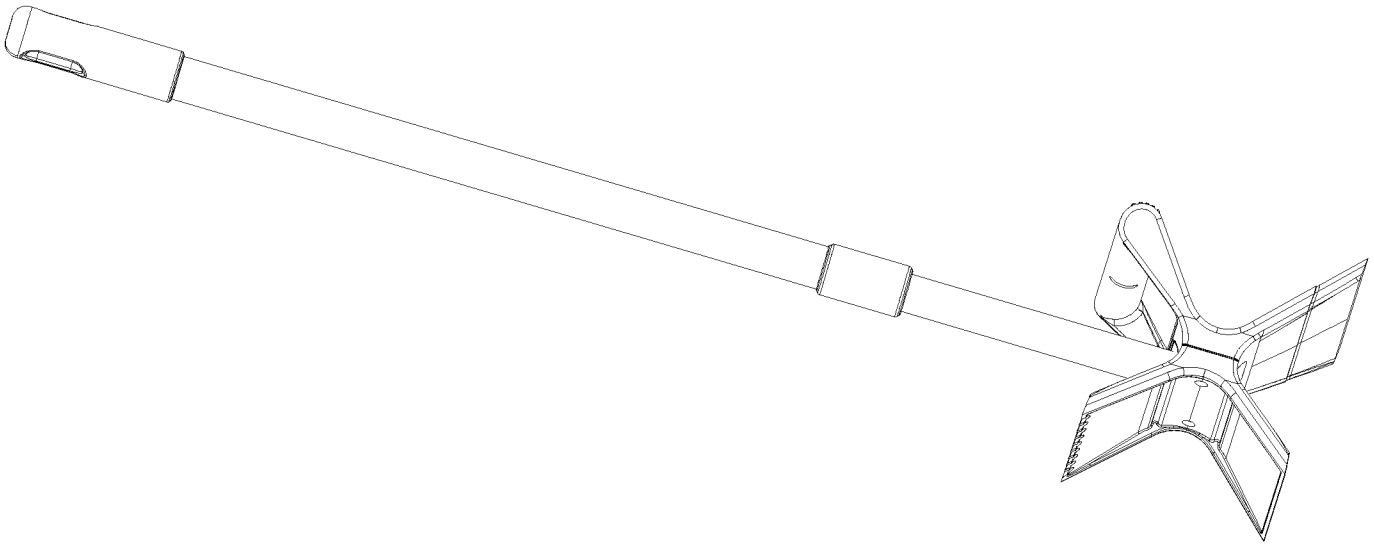
FIGS. 9-11 provide additional views of exemplary device embodiments.
Figure 10:
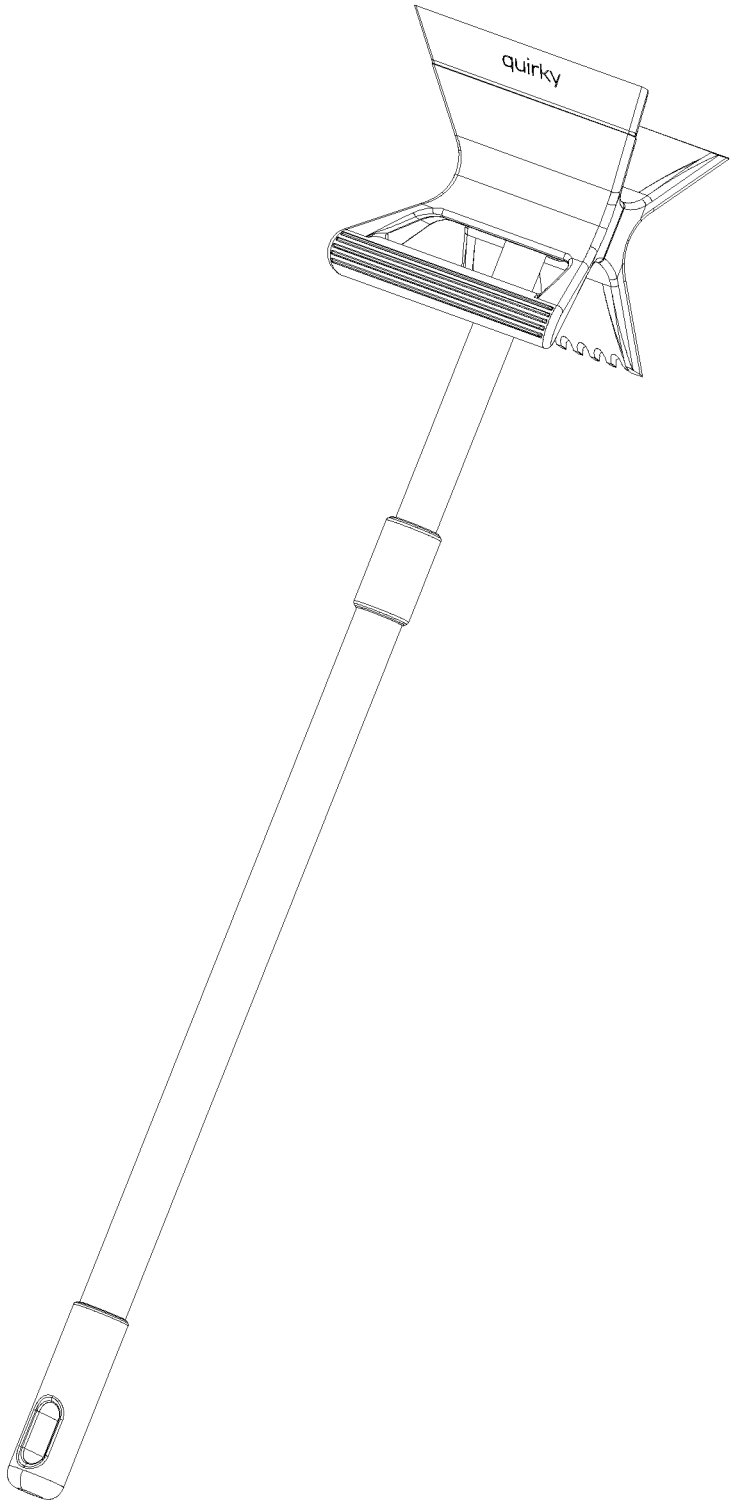
Figure 11:
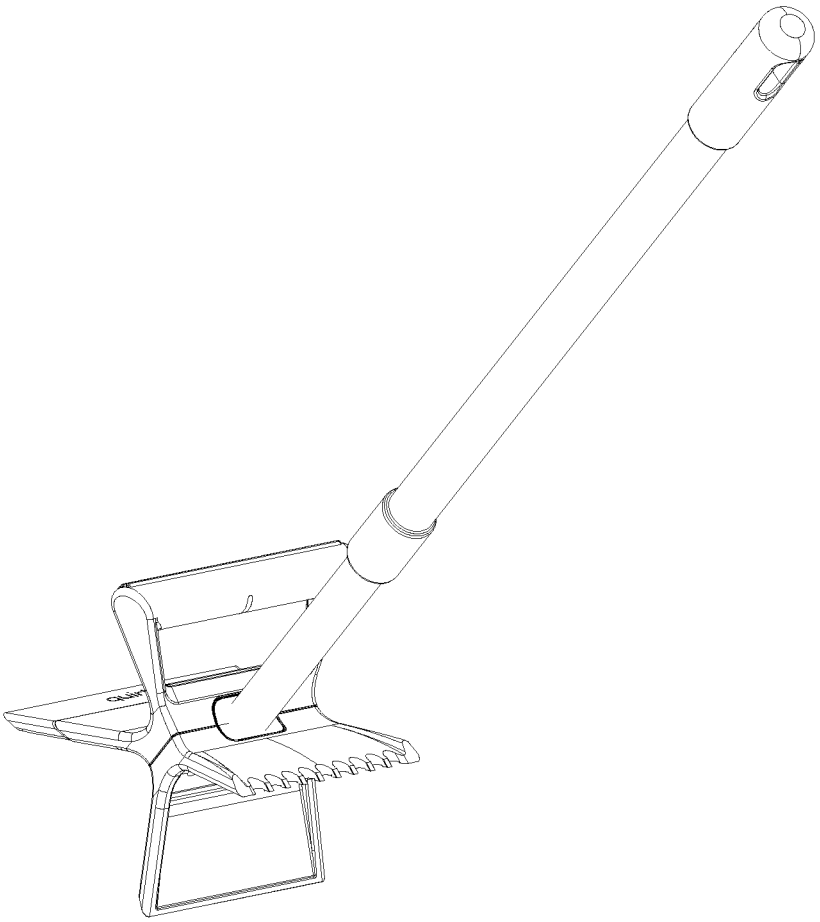
Figure 12:
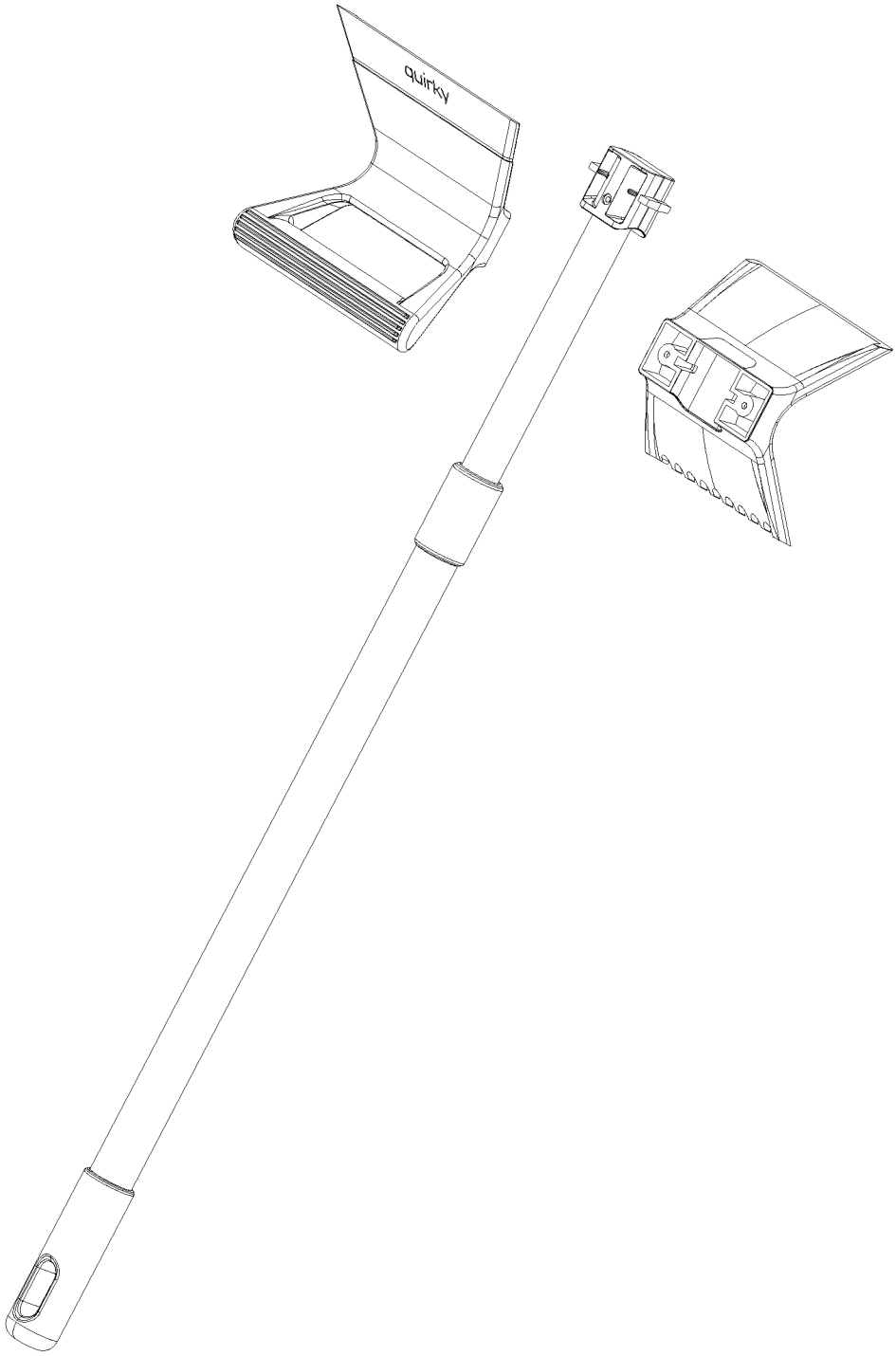
FIG. 12 provides an additional exploded view of a device embodiment.
Figure 13:
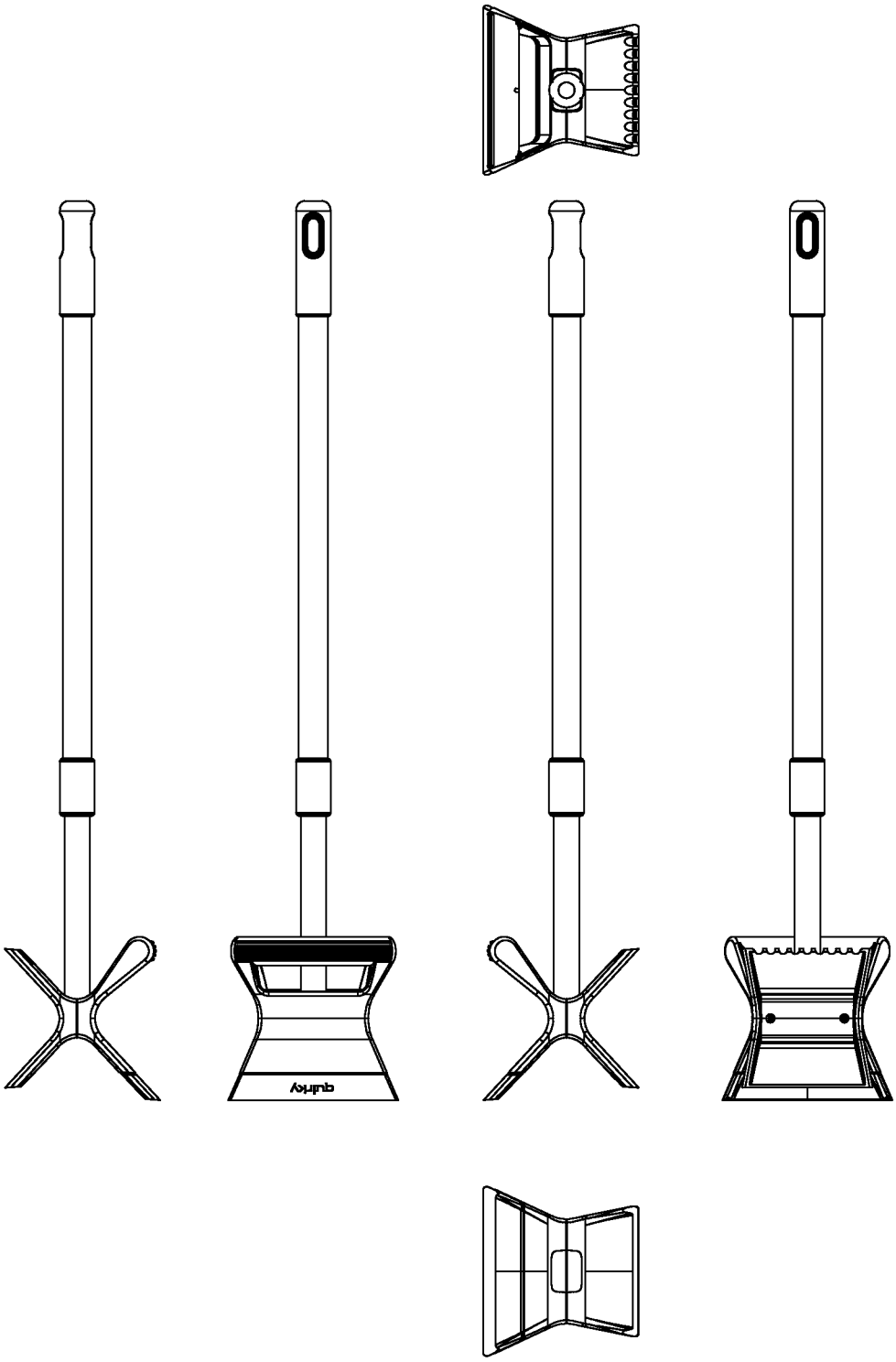
FIG. 13 shows additional views of exemplary embodiments.

Referring to FIG. 8, the coupling member 160 is configured to engage the first portion 130 and the second portion 150 of the tool head assembly 120. More specifically, the coupling member 160 may be configured to engage the mount 138 of the first portion 130 and the mount 156 of the second portion 150. Additionally, the coupling member 160 may include protrusions 164 configured to engage a surface and/or surfaces of the first portion 130 and the second portion 150 to ensure the alignment of the first portion 130 relative to the second portion 150. In this manner, the first portion 130 and the second portion 150 may receive, for example, a set of screws, such that the first portion 130, the second portion 150, and the coupling member 160 are coupled together.

Furthermore, the coupling portion 160 may include an opening 162 configured to receive a mounting portion 118 of the telescoping rod 114. In this manner, the coupling member 160 and the mounting portion 118 may receive, for example, a set of screws, such that the telescoping rod 114 and the coupling member 160 may be coupled together. The arrangement of the coupling member 160, the mounting portion 118, the first portion 130, and the second portion 150 may facilitate coupling of rod assembly 110 to tool head assembly 120.

In some embodiments, mounting portion 118 may be threaded and the coupling member 160 may be configured to receive a threaded rod. In some embodiments, the coupling member 160 may be configured to receive the mounting portion 118 and a pin or other mechanical fastener may be used to secure the rod assembly 110 to the head assembly.

The device 100 may be engaged by user to remove material from a surface, such as, ice from the surface of a window, wallpaper from a wall, a laminate from a floor or piece of furniture, and/or the like. By way of example, in some embodiments, a user may engage the device 100 to remove ice and/or snow from a window or other surface (e.g., the roof or hood of a car). In such embodiments, the user may engage the rod assembly 110 and adjust the rod assembly 110 to the desired length, via the adjustment member 116. With the length of the rod assembly 110 adjusted, the user may engage the grip 132 and place the scraping member 152 in contact with the ice covered window. In this manner, the user may move the device 100 relative to the window, such that the scraping member 152 scrapes the ice from the window. If all of the desired amount of ice is not removed from the window, the user may move the device 100 such that the chipping member 154 may engage the ice. In this manner, portions of the ice that were not removed by the scraping member 152 may be removed by the chipping member 154 without the need for a secondary tool or device. With the desired amount of ice removed, the device 100 may be rotated such that the blade 136 can engage the surface of the window to remove ice, snow, or other debris from the surface.

While certain exemplary embodiments have been described herein, it should be understood that they have been presented by way of example only, and not limitation. For example, while a method of removing ice from the surface of a window is described herein, it is presented by way of example only, and not limitation. In other embodiments, a similar method may be used to remove any suitable material from any surface.

Moreover, while certain exemplary embodiments have been particularly shown and described, it will be understood that various changes in form and details may be made. Although various embodiments have been described as having particular features and/or combinations of components, other embodiments may have a combination of features and/or components from any of the embodiments as discussed above.

We claim:

1. A device for removing material from a surface, comprising:

a head component comprising a first handle portion, a first scraper portion, a second scraper portion, and a third scraper portion; and a shaft component comprising a rod portion and a second handle portion, wherein said shaft component lies along a first axis, and wherein said first scraper portion and said first handle portion lie on substantially opposite sides of a second axis that is substantially orthogonal to said first axis, said second scraper portion and said third scraper portion lie on substantially opposite sides of said second axis, said first scraper portion and said first handle portion lie substantially in a first plane, said second scraper portion and said third scraper portion lie substantially in a second plane, and said first and second planes are substantially orthogonal.

2. A device as in claim 1, wherein said first handle portion is suitable for receiving a portion of a user's hand.

3. A device as in claim 2, wherein said first handle portion comprises an aperture suitable for receiving a portion of a user's hand.

4. A device as in claim 3, wherein said first handle portion comprises a rubber grip component.

5. A device as in claim 1, wherein said second scraper portion comprises a blade with a serrated edge.

6. A device as in claim 1, wherein said second scraper portion comprises a squeegee blade.

7. A device as in claim 1, wherein said second scraper portion comprises a metal blade.

8. A device as in claim 1, wherein said third scraper portion comprises a squeegee blade.

9. A device as in claim 1, wherein said third scraper portion comprises a blade with a serrated edge.

10. A device as in claim 1, wherein said third scraper portion comprises a metal blade.

11. A device as in claim 1, wherein said first handle portion comprises a rubber grip component.

12. A device as in claim 1, wherein said rod portion comprises a telescoping rod.

13. A device as in claim 1, wherein said first handle portion and said second scraper portion are formed from a first single curved component, and said first scraper portion and said third scraper portion are formed from a second single curved component.

14. A device as in claim 1, wherein said shaft component lies along an axis, wherein said first handle portion and said second scraper portion are formed from a first component, and said first scraper portion and said third scraper portion are formed from a second component, and wherein said first and second components lie on opposite sides of said axis.

15. A device as in claim 1, wherein said rod portion has a substantially circular cross-section.

16. A device as in claim 1, wherein said shaft component lies along a first axis, and wherein said first scraper portion, said second scraper portion, said third scraper portion, and said first handle portion are symmetrically distributed about a second axis that is substantially orthogonal to said first axis.

17. A device for removing material from a surface, comprising:

a head component comprising a first handle portion, a first scraper portion, a second scraper portion, and a third scraper portion; and a shaft component comprising a rod portion and a second handle portion, wherein said shaft component lies along an axis, said first handle portion and said second scraper portion are formed from a first component, said first scraper portion and said third scraper portion are formed from a second component, and said first and second components lie on opposite sides of said axis.

18. A device as in claim 17, wherein said first handle portion is suitable for receiving a portion of a user's hand.

19. A device as in claim 18, wherein said first handle portion comprises an aperture suitable for receiving a portion of a user's hand.

20. A device as in claim 19, wherein said first handle portion comprises a rubber grip component.

21. A device as in claim 17, wherein said second scraper portion comprises a blade with a serrated edge.

22. A device as in claim 17, wherein said second scraper portion comprises a squeegee blade.

23. A device as in claim 17, wherein said second scraper portion comprises a metal blade.

24. A device as in claim 17, wherein said third scraper portion comprises a squeegee blade.

25. A device as in claim 17, wherein said third scraper portion comprises a blade with a serrated edge.

26. A device as in claim 17, wherein said third scraper portion comprises a metal blade.

27. A device as in claim 17, wherein said first handle portion comprises a rubber grip component.

28. A device as in claim 17, wherein said rod portion comprises a telescoping rod.

29. A device as in claim 17, wherein said shaft component lies along a first axis, and wherein said first scraper portion and said first handle portion lie on substantially opposite sides of a second axis that is substantially orthogonal to said first axis.

30. A device as in claim 29, wherein said second scraper portion and said third scraper portion lie on substantially opposite sides of said second axis.

31. A device as in claim 17, wherein said first handle portion and said second scraper portion are formed from a first single curved component, and said first scraper portion and said third scraper portion are formed from a second single curved component.

32. A device as in claim 17, wherein said rod portion has a substantially circular cross-section.

33. A device as in claim 17, wherein said shaft component lies along a first axis, and wherein said first scraper portion, said second scraper portion, said third scraper portion, and said first handle portion are symmetrically distributed about a second axis that is substantially orthogonal to said first axis.

34. A device for removing material from a surface, comprising:

a head component comprising a first handle portion, a first scraper portion, a second scraper portion, and a third scraper portion; and a shaft component comprising a rod portion and a second handle portion, wherein said shaft component lies along a first axis, and wherein said first scraper portion, said second scraper portion, said third scraper portion, and said first handle portion are symmetrically distributed about a second axis that is substantially orthogonal to said first axis.

35. A device as in claim 34, wherein said first handle portion is suitable for receiving a portion of a user's hand.

36. A device as in claim 35, wherein said first handle portion comprises an aperture suitable for receiving a portion of a user's hand.

37. A device as in claim 36, wherein said first handle portion comprises a rubber grip component.

38. A device as in claim 34, wherein said second scraper portion comprises a blade with a serrated edge.

39. A device as in claim 34, wherein said second scraper portion comprises a squeegee blade.

40. A device as in claim 34, wherein said second scraper portion comprises a metal blade.

41. A device as in claim 34, wherein said third scraper portion comprises a squeegee blade.

42. A device as in claim 34, wherein said third scraper portion comprises a blade with a serrated edge.

43. A device as in claim 34, wherein said third scraper portion comprises a metal blade.

44. A device as in claim 34, wherein said first handle portion comprises a rubber grip component.

45. A device as in claim 34, wherein said rod portion comprises a telescoping rod.

46. A device as in claim 34, wherein said shaft component lies along a first axis, and wherein said first scraper portion and said first handle portion lie on substantially opposite sides of a second axis that is substantially orthogonal to said first axis.

47. A device as in claim 46, wherein said second scraper portion and said third scraper portion lie on substantially opposite sides of said second axis.

48. A device as in claim 34, wherein said first handle portion and said second scraper portion are formed from a first single curved component, and said first scraper portion and said third scraper portion are formed from a second single curved component.

49. A device as in claim 34, wherein said rod portion has a substantially circular cross-section.

* * * * *